US006142212A

United States Patent [19]

Scholz et al.

[11] Patent Number: 6,142,212

[45] Date of Patent: Nov. 7, 2000

[54] CONTINUOUS CASTING MOLD AND METHOD

[75] Inventors: Heinrich Scholz, Mettmann; Klaus-Peter Eberwein, Erkrath; Axel Weyer, Wuppertal, all of Germany

[73] Assignee: SMS Schloemann-Siemag Aktiengesellschaft, Düsseldorf, Germany

[21] Appl. No.: 09/177,296

[22] Filed: Oct. 22, 1998

[30] Foreign Application Priority Data

Oct. 31, 1997 [DE] Germany ..... 197 48 305

[51] Int. Cl.[7] ..... B22D 11/05; B22D 11/16

[52] U.S. Cl. ..... 164/452; 164/154.4; 164/154.8; 164/436; 164/491

[58] Field of Search ..... 164/452, 491, 164/154.1, 154.8, 154.5, 436

[56] References Cited

FOREIGN PATENT DOCUMENTS

| | | | |
|---|---|---|---|
| 0101521 | 2/1984 | European Pat. Off. . | |
| 0134030 | 3/1985 | European Pat. Off. . | |
| 2442091 | 7/1980 | France | 164/436 |
| 3247207 | 7/1984 | Germany | 164/436 |
| 54-128939 | 10/1979 | Japan | 164/436 |
| 58-13439 | 1/1983 | Japan | 164/491 |
| 59-73161 | 4/1984 | Japan | 164/452 |
| 60-33855 | 2/1985 | Japan | 164/491 |
| 3-138060 | 6/1991 | Japan | 164/491 |

OTHER PUBLICATIONS

Patents Abstracts of Japan, vol. 009, No. 029 (M–356), Feb. 7, 1985 & JP 59–174251 A (Sumitomo Jukikai Kogyo KK), Oct. 2, 1984.

Patents Abstracts of Japan, vol. 008, No. 195 (M–323), Sep. 7, 1984 & JP 59–085350 A (Shin Nippon Seitetsu KK), May 17, 1984.

Patents Abstracts of Japan, vol. 016, No. 217 (M–1252), May 21, 1992 & JP 04–041061 A (Nisshin Steel Co Ltd), Feb. 12, 1992.

*Primary Examiner*—J. Reed Batten, Jr.
*Attorney, Agent, or Firm*—Friedrich Kueffner

[57] ABSTRACT

A continuous casting mold with two oppositely located short side walls and two oppositely located long side walls which extend past the short side walls, wherein at least one of the short side walls is moveable by an adjusting member toward or away from the other short side wall. The adjusting member is constructed in the form of two hydraulic cylinder units which can be actuated independently from each other, wherein each hydraulic cylinder unit has a cylinder and a piston which is adjustable relative to the cylinder in an adjusting direction.

13 Claims, 1 Drawing Sheet

CONTINUOUS CASTING MOLD AND METHOD

BACKGROUND OF THE INVENTION

1. Field of the Invention

The present invention relates to a continuous casting mold with two oppositely located short side walls and two oppositely located long side walls which extend past the short side walls, wherein at least one of the short side walls is moveable by means of an adjusting member toward or away from the other short side wall.

2. Description of the Related Art

A mold of the above-described type is disclosed, for example, in EP 0 613 743 A1. In this mold, the short side wall is adjusted by means of a spindle driven by an electric motor and a gear unit, wherein the angle of inclination of the short side wall can be adjusted through a releasable coupling.

The continuous casting mold of the prior art discussed above is still not quite satisfactory because several mechanical elements are arranged between the drive in the form of an electric motor and the narrow side wall. This increases the costs and also increases the required maintenance. Moreover, the accuracy of adjustment of the short side wall of the mold is limited by the sum of the plays of the units located therebetween, i.e., couplings, gear units, etc.

SUMMARY OF THE INVENTION

Therefore, it is the primary object of the present invention to provide a continuous casting mold in which a higher accuracy of adjustment can be achieved.

In accordance with the present invention, the adjusting member is constructed in the form of two hydraulic cylinder units which can be actuated independently from each other, wherein each hydraulic cylinder unit has a cylinder and a piston which is adjustable relative to the cylinder in an adjusting direction.

When the hydraulic cylinder units and the short side wall are connected to each other through separable couplings, individual components of the continuous casting mold, for example, an individual short side wall, can be exchanged as necessary without having to replace the entire continuous casting mold.

The couplings preferably have a coupling play of less than 0.3 mm, for example, only 0.1 mm. Such a small coupling play can be achieved because the couplings are composed of two coupling halves, wherein a coupling halve each is assigned to the hydraulic cylinder units and the short side wall, wherein the coupling halves are screwed together along a coupling surface, and wherein the coupling surface intersects the adjusting direction at an angle which differs from 90°.

When clamping bodies for locking the pistons are provided for the hydraulic cylinder units, the position of the short side wall cannot change by itself. If the clamping bodies are additionally spring-biased, an adjustment of the pistons and a corresponding adjustment of the short side wall is only possible if the clamping bodies are released by the hydraulic pressure. Consequently, if there is a failure of the electrical energy supply or the hydraulic liquid, the short side wall is automatically locked in its present position.

By providing the hydraulic cylinder units with pressure sensors for determining the hydraulic pressures prevailing in the hydraulic cylinder units, it is possible to directly monitor the load of the continuous casting mold.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
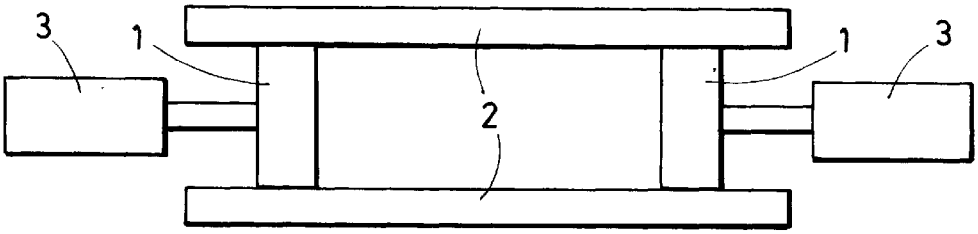
FIG. 1 is a schematic top view of a continuous casting mold.

As illustrated in FIG. 1, a continuous casting mold has two oppositely located short side walls 1 and two oppositely located long side walls 2. The long side walls extend past or over the short side walls 1. In the illustrated embodiment, both short side walls 1 can be moved toward each other and away from each other by means of adjusting members 3. In principle, it is also sufficient if only one of the short side walls is adjustable.

Figure 2:
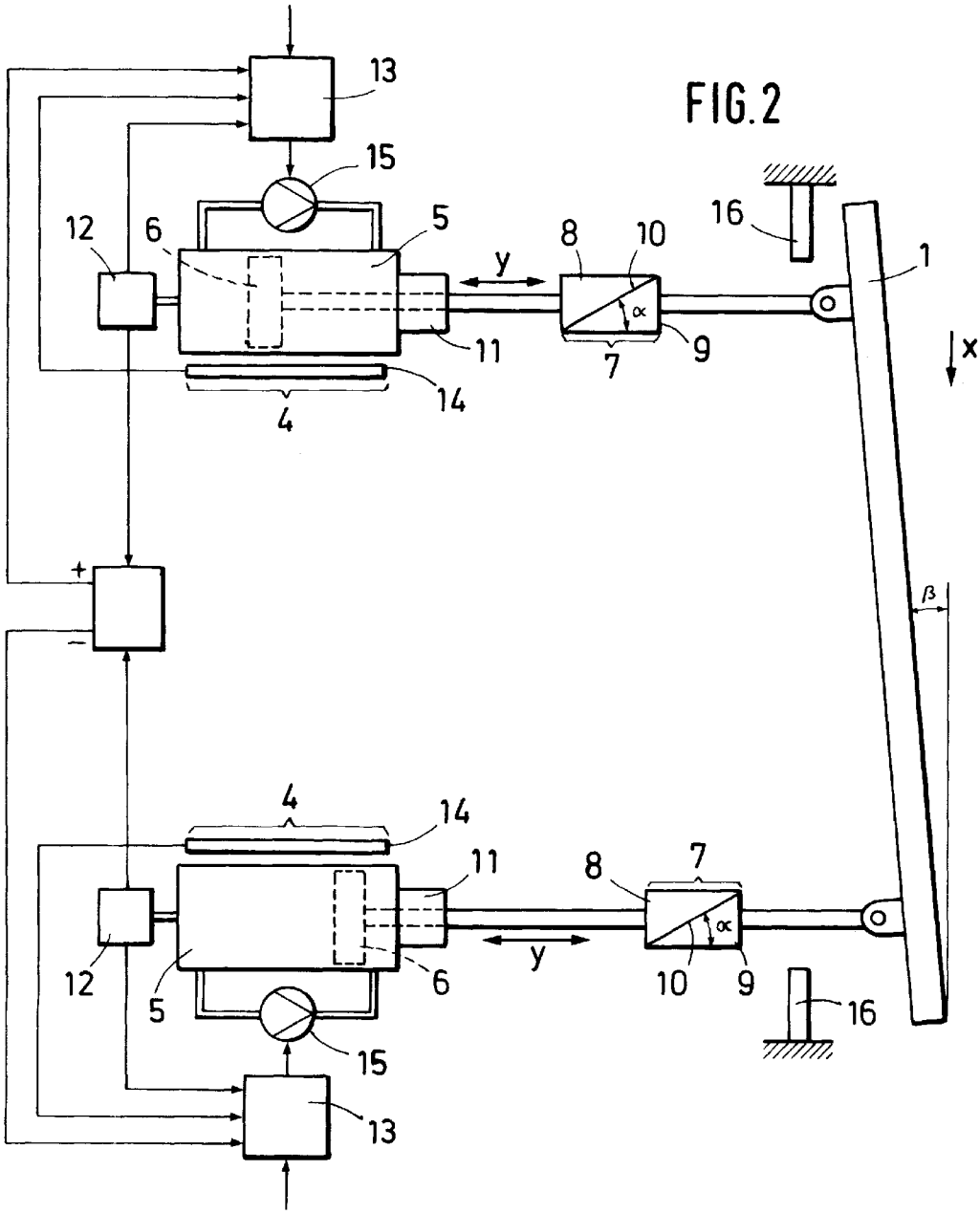
FIG. 2 is a side view, on a larger scale, of a short side wall with adjusting members.

As illustrated in FIG. 2, the adjusting member 3 of a short side wall 1 is composed of two hydraulic cylinder units 4 which can be actuated independently of each other. Each hydraulic cylinder unit 4 has a cylinder 5 and a piston 6. The hydraulic cylinder units are arranged one above the other as seen in the casting direction x.

The hydraulic cylinder units 4 are connected to the short side wall 1 through separable couplings 7. Each coupling 7 is composed of two coupling halves 8 and 9, wherein one of the coupling halves is assigned to the short side wall 1 and the other of the coupling halves is assigned to the corresponding hydraulic cylinder unit 4. As illustrated in FIG. 2, the coupling halves are connected to each other along a coupling surface which intersects the adjusting direction y of the hydraulic cylinder unit 4 at an angle $\alpha$ which differs from 90°. In order to make the couplings 7 separable, the coupling halves are preferably screwed together at the coupling surface 10. When the above-described configuration of the couplings 7 is used, the coupling play can be reduced to 0.1 mm.

The hydraulic cylinder units 4 are additionally provided with spring-biased clamping bodies 11. The pistons 6 can be locked relative to the cylinders 5 by means of these clamping bodies 11. Consequently, the narrow side wall cannot be adjusted by itself when the clamping body 11 is actuated. Since the clamping bodies 11 are spring-biased, the clamping bodies 11 are automatically locked when there is a failure of the electrical energy supply of the hydraulic cylinder units 4 or when the hydraulic pressure drops suddenly, for example, because of a defective hose.

As further illustrated in FIG. 2, the hydraulic cylinder units 4 are provided with pressure sensors 12 for determining the hydraulic pressures prevailing in the hydraulic cylinder units 4. The hydraulic pressure makes it possible, for example, to determine the extent to which a strand which has just been cast and is located in the continuous casting mold is deformable. The pressures determined by the pressure sensors 12 are supplied as correction variables to position control circuits 13. The signals of linear distance pickups 14 are supplied as actual values to these control circuits 13, wherein the linear distance pickups 14 determine the positions of the pistons 6 relative to the cylinders 5. Linear distance pickups for hydraulic cylinders are known in the art, so that a detailed description thereof is unnecessary.

A superimposed control, not shown, additionally supplies a desired value to the position control circuits 13. Taking into consideration the pressure prevailing in the respective hydraulic cylinder 4, the position control circuits 13 determine from the difference between the desired value and the actual value an adjusting signal as a correction value. The adjusting signal is supplied to a hydraulic pump 15 which actuates the corresponding hydraulic cylinder unit 4.

The positions of the pistons 6 relative to the corresponding cylinders 5 can be determined by the linear distance pickups 14. Consequently, the relative adjusting distance of the pistons 6 can be determined directly by the linear distance pickups 14. A reference point is then required for being able to convert this relative adjustment into an absolute adjustment of the short side wall 1. Therefore, for calibrating the position control for the short side wall 1, the short side wall 1 is moved prior to continuous casting away from the other short side wall 1 until it makes contact with the stops 16. These stops 16 constitute fixed reference points relative to the continuous casting mold. Subsequently, taking into consideration the signals of the linear distance pickups 14 generated when the stops 16 are reached, the signals transmitted by the linear distance pickups 14 can be converted into an absolute adjusting distance for the short side wall 1. Consequently, the position control of the short side wall 1 can be calibrated in this manner.

Since it is now possible in accordance with the present invention to compute the adjusting forces based on the determined hydraulic pressure, it is now also possible to carry out an optimum adjustment of the short side wall during casting. For this purpose, the position control circuits 13 of the short side wall 1 are also supplied with the determined pressures of the other position control circuit 13 of the short side wall 1. From the difference or the ratio of the pressures relative to each other it is then possible to determine whether the short side wall adjustment is correct. For example, if the ratio of the pressure determined by the upper pressure sensor 12 as seen in FIG. 2 relative to the pressure determined by the lower pressure sensor 12 as seen in FIG. 2 is between 1:1 and 3:1, there will be no change of the adjusting angle β. On the other hand, when the ratio exceeds 3:1, the adjusting angle β is increased until the ratio of the pressure reaches the value 2:1. Conversely, when the value drops below 1:1, the adjusting angle β is reduced until the pressure ratio reaches 2:1.

While specific embodiments of the invention have been shown and described in detail to illustrate the inventive principles, it will be understood that the invention may be embodied otherwise without departing from such principles.

We claim:

1. A continuous casting mold comprising first and second oppositely located short side walls and two oppositely located long side walls extending past the short side walls, an adjusting member for moving at least the first short side wall toward and away from the second short side wall, wherein the adjusting member is comprised of two hydraulic cylinder units configured to be actuated independently of each other, each hydraulic cylinder unit having a cylinder and a piston adjustable in an adjusting direction relative to the cylinder, further comprising separable couplings connecting the hydraulic cylinder units and the first short side wall.

2. The continuous casting mold according to claim 1, wherein the hydraulic cylinder units are arranged one above the other in a casting direction.

3. The continuous casting mold according to claim 1, wherein the couplings have a coupling play of less than 0.3 mm.

4. The continuous casting mold according to claim 1, wherein each coupling is comprised of two coupling halves, wherein one coupling half is in connection with the hydraulic cylinder unit and another coupling half is in connection with the first short side wall, wherein the coupling halves of each coupling are screwed together along a coupling surface, and wherein the coupling surface intersects the adjusting direction at an angle which differs from 90°.

5. The continuous casting mold according to claim 1, wherein the hydraulic cylinder units comprise linear distance pickups for determining a position of the pistons relative to the cylinders.

6. A continuous casting mold comprising first and second oppositely located short side walls and two oppositely located long side walls extending past the short side walls, an adjusting member for moving at least the first short side wall toward and away from the second short side wall, wherein the adjusting member is comprised of two hydraulic cylinder units configured to be actuated independently of each other, each hydraulic cylinder unit having a cylinder and a piston adjustable in an adjusting direction relative to the cylinder, wherein the hydraulic cylinder units comprise clamping bodies for locking the pistons.

7. The continuous casting mold according to claim 6, wherein the clamping bodies are spring-biased.

8. A continuous casting mold comprising first and second oppositely located short side walls and two oppositely located long side walls extending past the short side walls, an adjusting member for moving at least the first short side wall toward and away from the second short side wall, wherein the adjusting member is comprised of two hydraulic cylinder units configured to be actuated independently of each other, each hydraulic cylinder unit having a cylinder and a piston adjustable in an adjusting direction relative to the cylinder, wherein the hydraulic cylinder units comprise pressure sensors for determining hydraulic pressures prevailing in the hydraulic cylinder units.

9. A method of operating a continuous casting mold having two oppositely located long side walls and two oppositely located short side walls, and at least one hydraulic cylinder unit with a cylinder and a piston for adjusting at least one of the short side walls, the method comprising determining a position of the piston relative to the cylinder by a linear distance pickup provided for the hydraulic cylinder unit, and supplying the position of the piston to a position control circuit for actuating a hydraulic pump for the hydraulic cylinder unit, further comprising determining a pressure prevailing in a hydraulic liquid of the hydraulic cylinder unit and supplying the pressure to the position control circuit as a correction variable.

10. A method of operating a continuous casting mold having two oppositely located long side walls and two oppositely located short side walls, and at least one hydraulic cylinder unit with a cylinder and a piston for adjusting at least one of the short side walls, the method comprising determining a position of the piston relative to the cylinder by a linear distance pickup provided for the hydraulic cylinder unit, and supplying the position of the piston to a position control circuit for actuating a hydraulic pump for the hydraulic cylinder unit, wherein the at least one short side wall is additionally adjustable by a second hydraulic cylinder unit, comprising determining a hydraulic pressure prevailing in the second hydraulic cylinder unit and supplying the hydraulic pressure to the first hydraulic cylinder unit as a correction variable.

11. A method of operating a continuous casting mold having two oppositely located long side walls and two oppositely located short side walls, and at least one adjusting member unit with a cylinder and a piston for adjusting at least one of the short side walls, the method comprising determining an adjustment distance of the adjusting member by a linear distance pickup for controlling a position of the at least one short side wall, moving the at least one short side wall toward a fixed point relative to the continuous casting mold for effecting a calibration, and subsequently, by taking into consideration a signal generated when the fixed point is reached, converting signals transmitted by the linear distance pickup into an absolute adjusting distance for the at least one short side wall.

12. The method according to claim 11, wherein the adjusting member is a hydraulic cylinder unit.

13. The method according to claim 11, wherein the at least one short side wall is moved against a stop for effecting the calibration.

* * * * *